US006077111A

United States Patent [19]

Machado et al.

[11] Patent Number: 6,077,111

[45] Date of Patent: Jun. 20, 2000

[54] MOUNTING ASSEMBLY FOR RIGIDLY INTEGRATING A COMPONENT THEREWITH

[75] Inventors: Peter W. Machado, Fairhaven, Mass.; Edward C. Baccei, Portsmouth, R.I.

[73] Assignee: The United States of America as represented by the Secretary of the Navy, Washington, D.C.

[21] Appl. No.: 09/208,155

[22] Filed: Dec. 1, 1998

[51] Int. Cl.[7] ..... H01R 13/52

[52] U.S. Cl. ..... 439/519; 439/620

[58] Field of Search ..... 439/519, 604, 439/533, 933, 521, 522, 606, 588, 589, 620

[56] References Cited

U.S. PATENT DOCUMENTS

| | | | |
|---|---|---|---|
| 3,986,161 | 10/1976 | MacKellar | 340/6 R |
| 4,663,601 | 5/1987 | Troutman et al. | 335/207 |
| 5,010,529 | 4/1991 | Maynus | 367/137 |
| 5,054,778 | 10/1991 | Maleyko | 273/58 |
| 5,077,841 | 1/1992 | Sugai | 4/542 |
| 5,387,119 | 2/1995 | Wood | 439/281 |
| 5,400,008 | 3/1995 | Toohey | 340/321 |
| 5,503,175 | 4/1996 | Ravillous et al. | 137/1 |
| 5,888,156 | 5/1999 | Cmiel et al. | 473/570 |

*Primary Examiner*—Gary F. Paumen
*Assistant Examiner*—Ross Gushi
*Attorney, Agent, or Firm*—Michael J. McGowan; Robert W. Gauthier; Prithvi C. Lall

[57] ABSTRACT

A protective mounting assembly includes an electrical connector having a waterproof body surrounding and protecting a waterproof interface. Components' signal leads are coupled to the interface at a first side thereof. A rigid foundation is rigidly coupled to the connector's waterproof body. A rigid positioning platform is rigidly coupled to the rigid foundation and defines at least one mounting position for the components. The components are positively oriented relative to the mounting positions. An elastomer material encapsulates the rigid foundation, positioning platform, components and a portion of the waterproof body in such a way that the connections at a second side of the connector's interface are accessible from the exterior of the elastomer material.

15 Claims, 2 Drawing Sheets

MOUNTING ASSEMBLY FOR RIGIDLY INTEGRATING A COMPONENT THEREWITH

CROSS-REFERENCE TO RELATED PATENT APPLICATIONS

This patent application is co-pending with one related patent application Ser. No. 08/064,360, filed Apr. 13, 1998, and entitled "SWITCH ASSEMBLY FOR WITHSTANDING SHOCK AND VIBRATION" (Navy Case No. 78479).

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to mounting assemblies for delicate components, and more particularly to a mounting assembly that rigidly integrates the component to the assembly in order to protect the component from installation loads while also precisely positioning the component relative to a mounting surface and protecting the component from water damage.

(2) Description of the Prior Art

Many underwater launching systems have sensing devices such as proximity switches (e.g., reed switches) mounted in launch tubes to sense launch tube hatch and valve positions. Since these switches are fragile and get wet, they must be protected from shock and water damage. Accordingly, the switch is typically encapsulated in an elastomer compound and wired to an electrical connector accessible from the exterior of the encapsulant. In order to mount the encapsulated switch in its desired location, threaded inserts are usually embedded in the encapsulant. Both the electrical connector and threaded inserts float within the encapsulant. The electrical connector experiences torque loads when a cable connector is coupled thereto and the threaded inserts experience torque loads when the encapsulated switch assembly is mounted in position. As a result, this arrangement has been prone to failure of the encapsulant around the electrical connector and the threaded inserts. In a seawater environment, failure of the encapsulant allows water to wick up into the switch and bring about premature failure thereof. Additionally, since the threaded inserts float in the encapsulant, it is difficult to assure consistency in locating the switches relative to the threaded inserts which ultimately determine the switch position.

SUMMARY OF THE INVENTION

Accordingly, it is an object of the present invention to provide an assembly for one or more components that are to be used in a wet environment.

Another object of the present invention is to provide an assembly for a sensing device that protects the device from shock.

Still another object of the present invention is to provide an elastomer-encapsulated assembly that is not prone to encapsulant failure during the use thereof.

Other objects and advantages of the present invention will become more obvious hereinafter in the specification and drawings.

In accordance with the present invention, a protective mounting assembly for at least one component having signal leads extending therefrom is provided. A connector has a waterproof body surrounding and protecting a waterproof interface. The interface has connections at a first side thereof coupled to connections at a second side thereof. The signal leads of the component(s) are coupled to the connections at the first side of the interface. A rigid foundation is rigidly coupled to the waterproof body. A rigid positioning platform is rigidly coupled to the rigid foundation and defines at least one mounting position for the component(s). The component(s) are positively oriented relative to the mounting position(s) so that the component(s) are fixed relative to a surface when the rigid foundation is rigidly coupled to the surface. An elastomer material encapsulates the rigid foundation, positioning platform, component(s) and a portion of the waterproof body in such a way that the connections at the second side of the interface are accessible from the exterior of the elastomer material.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughput the several views of the drawings and wherein.

DESCRIPTION OF THE PREFERRED EMBODIMENT(S)

Figure 1:
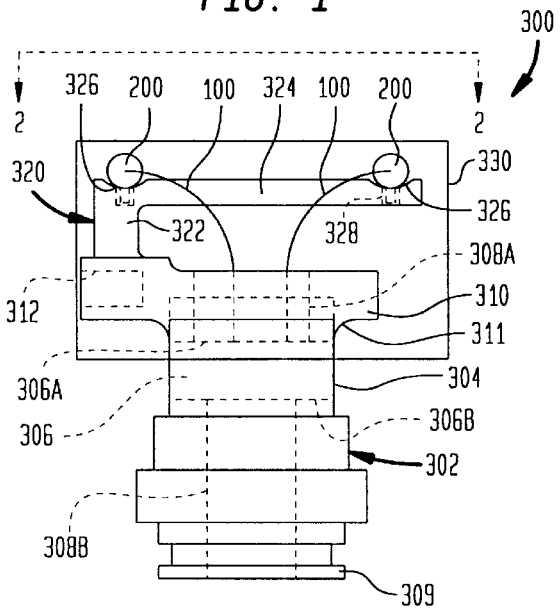
FIG. 1 is a side view of one embodiment of the assembly of the present invention.
Figure 2:
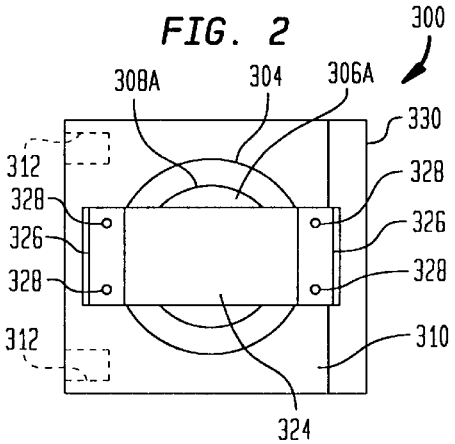
FIG. 2 is a view taken along line 2—2 of FIG. 1.

Referring now to the drawings and more particularly to FIGS. 1 and 2, one embodiment of the present invention is shown in a side and top view, respectively, and is referenced generally by numeral 300. By way of example, assembly 300 will be described in terms of positioning, protecting (e.g., in terms of shock, torque and vibration loads) and waterproofing a component such as a proximity sensing switch or reed switch housed in mounting assembly 200. However, it is to be understood that the present invention can be used to accomplish the same functions for other types of components and is not limited to use with reed switches. Further, while the present invention is illustrated as supportive of two such (switch) mounting assemblies 200, the present invention can be constructed for more or less than two such assemblies. Note that assemblies 200 have been omitted from FIG. 2 for clarity of illustration.

Assembly 300 includes a connector 302 such as any conventional electrical connector used in a wet environment. Such waterproof connectors are well known in the art and will therefore only be described briefly herein. For example, connector 302 typically has a rigid waterproof outer body 304 that encases or surrounds an electrical connection interface 306. Interface 306 is itself a waterproof barrier between its opposing faces 306A and 306B. Face 306A provides connecting points or nodes (not shown) for signal leads 100 extending from the reed switches in assemblies 200 through a bore 308A leading to face 306A. A similar bore 308B leads to face 306B from the opposite end of connector 302. Interface 306 electrically connects the nodes at face 306A with connection nodes (not shown) at face 306B. In use, a mating connector (not shown) is coupled to a hardware end 309 of connector 302 by means of twisting or pushing together as is well known in the art.

Affixed to outer body 304 is a rigid base 310 that serves as a foundation for the remainder of the assembly. For strength and stability, base 310 is attached about the entire circumference of outer body 304 although this need not be the case. As indicated by reference numeral 311, base 310 can be welded, brazed or glued to outer body 304, or made integral with outer body 304, depending on the application and materials used. Base 310 can also be provided with bore(s) 312 that receive mounting pins or screws (not shown) in order to mount assembly 300 to some surface. Alternatively, bore(s) 312 could be replaced with pins or screws extending from base 310 which would be inserted into corresponding bores of a mounting surface.

Base 310 supports a positioning platform 320 in a rigid fashion via either attachment to or integration therewith. Specifically, platform 320 has an extension portion 322 and a mounting portion 324. Extension portion 322 positions mounting portion 324 for proper placement of assemblies 200 for a particular application. Mounting portion 324 defines specific mounting positions and orientations for each of assemblies 200. For example, mounting portion 324 can define cradles 326 that receive and position assemblies 200 perpendicular to the longitudinal axis of connector 302. In order to positively orient each assembly 200 in its respective cradle 326, each cradle has a plurality of holes 328 (e.g., two are shown) that receive correspondingly-aligned pins extending from each assembly 200 as will be described and illustrated later with reference to FIG. 5. While the length of each cradle 326 is not a limitation of the present invention, each cradle 326 is typically sized so that signal leads 100 attached to the end(s) of the reed switch are unencumbered when assembly 200 is positioned in cradle 326. Further, each cradle 326 is located laterally of interface 306 in order to facilitate connections of signal leads 100 to interface 306.

Once assemblies 200 have been mounted in cradles 326 and signal leads 100 have been connected to interface 306, assembly 300 is partially encapsulated to waterproof same. Specifically, an elastomeric encapsulant material 330 (e.g., urethane, glass reinforced epoxy, polyethylene, etc.) encases part of outer body 304 substantially along bore 308A, base 310, extension portion 322, mounting portion 324 and assemblies 200 to include signal leads 100. Material 330 can also be allowed to fill bore 308A up to face 306A. In this way, assemblies 200 as well as their connections to interface 306 are fully waterproofed since no water can get through material 330 or through interface 306.

Figure 3:
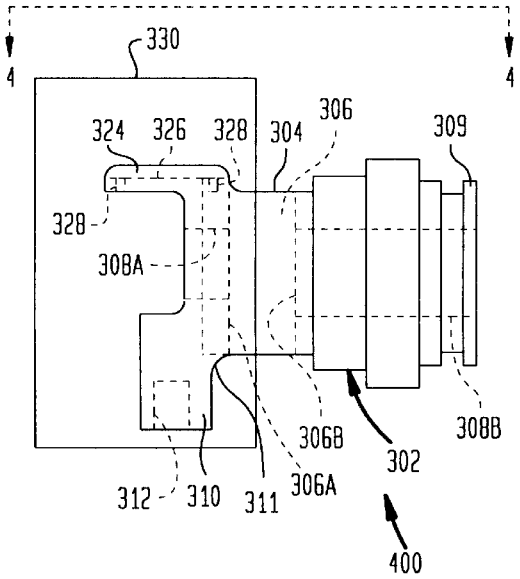
FIG. 3 is a side view of another embodiment of the present invention.
Figure 4:
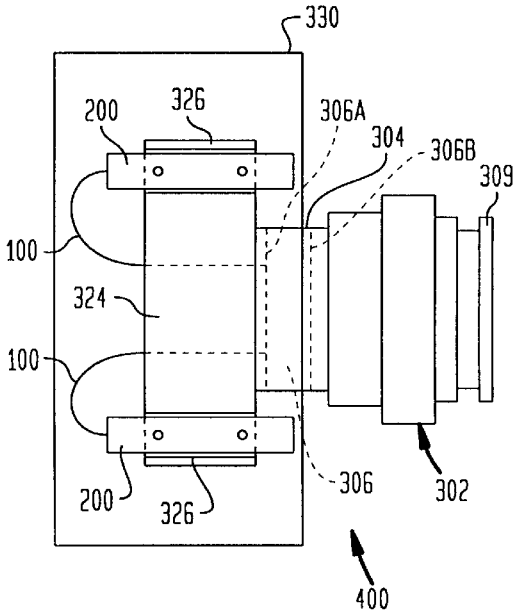
FIG. 4 is a view taken along line 4—4 of FIG. 3.

The embodiment illustrated in FIGS. 1 and 2 is suitable for orienting assemblies 200 perpendicular to the longitudinal axis of connector 302. However, the present invention could also be adapted to orient assemblies differently, e.g., parallel to the longitudinal axis of connector 302. Such an embodiment is illustrated in FIGS. 3 and 4 and is referenced generally as assembly 400. Like reference numerals are used for those elements that are common with the embodiment illustrated in FIGS. 1 and 2 and will not be described further. Note that assemblies 200 are omitted from FIG. 3 for clarity of illustration. In this embodiment, mounting portion 324 is affixed to or made integral with base 310 such that cradles 326 are parallel to the longitudinal axis of connector 302. Mounting portion 324 could also be angled towards or away from the longitudinal axis of connector 302 if a different orientation of assemblies 200 were needed. The orientation of assemblies 200 could also be altered by changing the angle or position of bores 312 used for mounting assembly 300 or 400.

Figure 5:
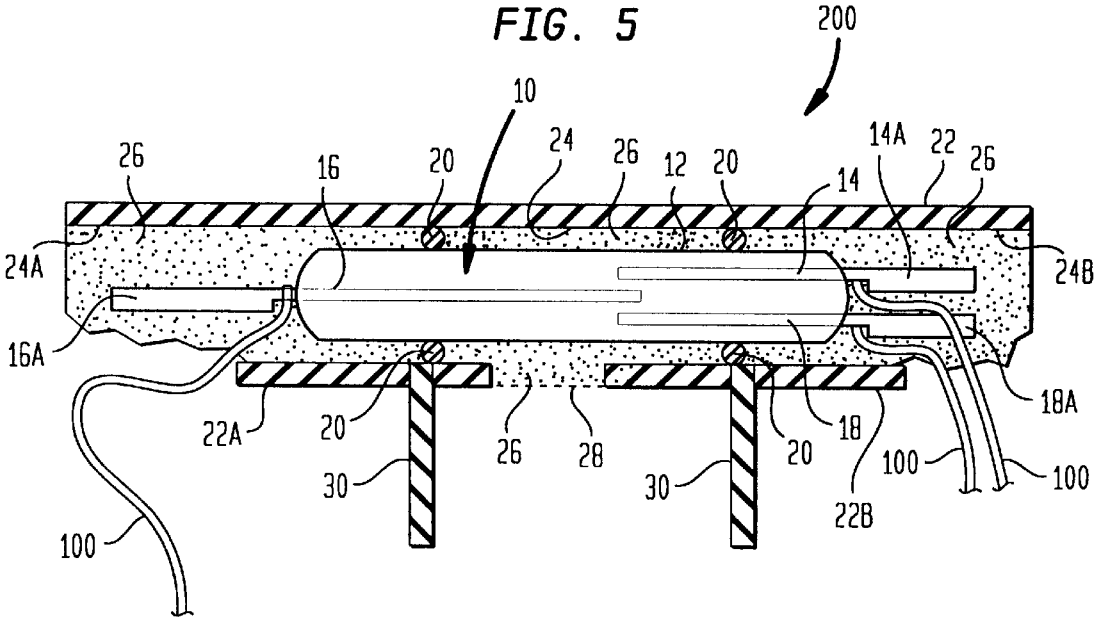
FIG. 5 is a cross-sectional view of one embodiment of a reed switch mounting assembly used in the present invention.

Each assembly 200 essentially consists of a reed switch and a mounting assembly that is adapted to fit into holes 328 of a cradle 326 for either of assemblies 300 or 400. One arrangement for assembly 200 is illustrated in FIG. 5 and disclosed in the afore-mentioned cross-referenced U.S. patent application Ser. No. 08/064,360, filed Apr. 13, 1998. Referring now to FIG. 5, switch assembly 200 includes a reed switch 10 having an air or gas-filled elongate glass body 12 hermetically sealing a plurality of contacts 14, 16 and 18 therein. In the illustrated reed switch, the tip of contact 16 is interleaved with the tips of contacts 14 and 18. Depending on the presence and/or location of a magnetic force, contact 16 will either remain neutral between contacts 14 and 18 or move towards and contact one of contacts 14 and 18. Each of contacts 14, 16 and 18 extends out through a respective end of glass body 12 for coupling to signal wires 100.

Two flexible seals or O-rings 20 are positioned about glass body 12 in a spaced-apart relation along the longitudinal axis of glass body 12. To assure that seals 20 stay in place during the assembly process, each of seals 20 can be bonded to glass body 12 with an adhesive. A hollow capsule or housing 22 encases the entire length of glass body 12 and seals 20 with the interior diameter of housing 22 sized such that it is in circumferential contact with each of seals 20. Seals 20 center glass body 12 in housing 22 so that an annular chamber 24 is defined between glass body 12, housing 22 and seals 20. Annular chamber 24 is filled with a vibration damping material 26 such as a flexible resin-type silicon or any material having vibration damping properties. As will be explained below, a port 28 is provided in the side of housing 22 to permit the introduction of damping material 26 into chamber 24.

Housing 22 extends past glass body 12 at either end thereof. More specifically, housing 22 extends at either end thereof to at least the ends 14A, 16A and 18A of contacts 14, 16 and 18, respectively, extending from glass body 12. As a result, open-ended chambers 24A and 24B are formed at either end of housing 20. However, rather than completely encasing ends 14A, 16A and 18A, a portion of chambers 24A and 24B is cut-away from the ends of housing 22 at 22A and 22B to simplify access to ends 14A, 16A and 18A. In this way, connection of signal leads 100 to ends 14A, 16A and 18A is simplified, while still providing protection for the connection of signal leads 100. Signal leads 100 can be connected anywhere along ends 14A, 16A and 18A. Each of open-ended chambers 24A and 24B can also be filled with damping material 26 once signal leads 100 are connected.

To facilitate proper positioning of switch assembly 200, a plurality (two are shown) of locator tabs or pins 30 are coupled to and extend from housing 22. Pins 30 can be rigid pins attached to (e.g., press-fit, glued, screwed, etc.) or integral with housing 22. When it is time to position switch assembly 200, pins 30 can be inserted into holes 328 of a cradle 326 as described above in order to insure the proper positioning of contacts 14, 16 and 18 for a particular application.

To make switch assembly 200, the following methodology is used. Seals 20 are placed on, and can be bonded to, glass body 12. The seal/glass body assembly is then threaded and pushed into one end of housing 22 until seals 20 are disposed on either side of port 28. Signal leads 100 are then attached to ends 14A, 16A and 18A. Damping material 26 is then introduced into annular chamber 24 via port 28 and, optionally, into open-ended chambers 24A and 24B.

The advantages of the present invention are numerous. Delicate components such as reed switches are mounted in a rigidly integrated connector assembly. Accordingly, transmission of external loads passed through the connector body are passed through the rigidly integrated base and extension/mounting portions, but not through the elastomeric encapsulant. This allows the integrity of the waterproof seal provided by the encapsulant to be maintained. In addition, because the encapsulant is not stressed by external loads, the connections of signal leads 100 remain stress-free in the encapsulant. Also, by rigidly integrating mounting portion 324 to the mounting foundation (i.e., base 310 with mounting bores 312), the relative position of each component assembly 200 can be accurately controlled. Further, each assembly 200 can be consistently and properly oriented through the use of the mounting pin/hole cooperation between each assembly 200 and corresponding cradle 326.

Although the present invention has been described relative to particular embodiments thereof, it is not so limited. For example, a variety of rigid materials can be used for base 310, extension portion 322 and mounting portion 324. Further, other means for positively orienting each component in its respective mounting position on mounting portion 324 could be used. For example, interlocking teeth or one-way keying systems could be provided on each assembly 200/mounting portion 324. Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A mounting assembly, comprising:

at least one component having signal leads extending therefrom;

a connector having a waterproof body surrounding and protecting a waterproof interface having connections at a first side thereof coupled to connections at a second side thereof, wherein said signal leads are coupled to said connections at said first side;

a rigid foundation rigidly coupled to said waterproof body;

a rigid positioning platform rigidly coupled to said rigid foundation for defining at least one mounting position for said at least one component, said at least one mounting position defined by at least one longitudinally-extending U-shaped cradle for receiving and cradling said at least one component;

means for positively orienting said at least one component relative to said at least one longitudinally-extending U-shaped cradle; and an elastomer material encapsulating said rigid foundation, said rigid positioning platform, said at least one component, said means for positively orienting and a portion of said waterproof body, wherein said connections at said second side of said waterproof interface are accessible from the exterior of said elastomer material.

2. An assembly as in claim 1 wherein said at least one component comprises a reed switch.

3. An assembly as in claim 1 wherein said means for positively orienting comprises:

a plurality of holes provided in said at least one longitudinally-extending U-shaped cradle; and a plurality of rigid projections coupled to said at least one component for engagement with said plurality of holes.

4. A mounting assembly, comprising:

a plurality of reed switches, each of said plurality of reed switches having signal leads extending from a first end and a second end thereof;

an electrical connector having a waterproof body surrounding and protecting a waterproof interface having connections at a first side thereof coupled to connections at a second side thereof, wherein said signal leads are coupled to said connections at said first side;

a rigid foundation rigidly coupled to said waterproof body;

a rigid positioning platform rigidly coupled to said rigid foundation for defining mounting positions for said plurality of reed switches, each of said mounting positions defined by a longitudinally-extending U-shaped cradle for radially receiving and cradling one of said plurality of reed switches between said first end and said second end thereof;

means for positively orienting each of said plurality of reed switches relative to a corresponding one of said longitudinally-extending U-shaped cradles; and an elastomer material encapsulating said rigid foundation, said rigid positioning platform, said plurality of reed switches, said means for positively orienting and a portion of said waterproof body, wherein said connections at said second side of said waterproof interface are accessible from the exterior of said elastomer material.

5. An assembly as in claim 4 wherein said means for positively orienting comprises:

a plurality of holes provided in each said longitudinally-extending U-shaped cradle; and a plurality of rigid projections coupled to each of said plurality of reed switches for engagement with said plurality of holes in one said longitudinally-extending U-shaped cradle.

6. An assembly as in claim 4 wherein said plurality of reed switches are positioned parallel to a longitudinal axis of said electrical connector by said rigid positioning platform.

7. An assembly as in claim 4 wherein said plurality of reed switches are positioned perpendicular to a longitudinal axis of said electrical connector by said rigid positioning platform.

8. An assembly as in claim 4 wherein each of said plurality of reed switches is positioned lateral of said waterproof interface by said rigid positioning platform.

9. A mounting assembly, comprising:

a plurality of reed switches, each of said plurality of reed switches having signal leads extending from a first end and a second end thereof;

a plurality of seals mounted in spaced apart relation about each reed switch of said plurality of reed switches;

a rigid housing encasing each of said plurality of reed switches and said plurality of seals mounted thereon, each rigid housing having a port formed in a side thereof for accessing a cavity therein, wherein said rigid housing is in circumferential contact with each of said plurality of seals;

a first seal and a second seal from said plurality of seals being spaced apart from one another on either side of said port, wherein an annular chamber is defined between said reed switch and said rigid housing between said first seal and said second seal;

a damping material filling said annular chamber;

an electrical connector having a waterproof body surrounding and protecting a waterproof interface having connections at a first side thereof coupled to connections at a second side thereof, wherein said signal leads are coupled to said connections at said first side;

a rigid foundation rigidly coupled to said waterproof body;

a rigid positioning platform rigidly coupled to said rigid foundation and defining a plurality of cradles positioned lateral of said waterproof interface for receiving and cradling said plurality of reed switches, each of said plurality of cradles supporting one said rigid housing encasing one of said plurality of reed switches between said first end and said second end thereof, each of said plurality of cradles having a plurality of holes formed therein;

a plurality of rigid projections extending outward from each said rigid housing for engagement with said plurality of holes in a respective one of said plurality of cradles, wherein each of said plurality of reed switches is maintained in a fixed and relative position; and an elastomer material encapsulating said rigid foundation, said rigid positioning platform, each said rigid housing encasing one of said plurality of reed switches, and a portion of said waterproof body, wherein said connections at said second side of said waterproof interface are accessible from the exterior of said elastomer material.

10. An assembly as in claim 9 wherein said plurality of reed switches are positioned parallel to a longitudinal axis of said electrical connector by said rigid positioning platform.

11. An assembly as in claim 9 wherein said plurality of reed switches are positioned perpendicular to a longitudinal axis of said electrical connector by said rigid positioning platform.

12. An assembly as in claim 9 wherein said first seal and said second seal are affixed to said reed switch.

13. An assembly as in claim 9 wherein said rigid housing, said plurality of rigid projections, said plurality of seals and said damping material are non-magnetic.

14. An assembly as in claim 9 wherein said damping material is silicon.

15. An assembly as in claim 9 wherein a portion of said rigid housing at either end thereof is cut away for facilitating coupling of said signal leads to said first end and said second end of said reed switch.

* * * * *